US009644617B2

(12) United States Patent
Dantlgraber et al.

(10) Patent No.: US 9,644,617 B2
(45) Date of Patent: May 9, 2017

(54) HYDROSTATIC AXIAL PISTON MACHINE

(71) Applicant: Robert Bosch GmbH, Stuttgart (DE)

(72) Inventors: Joerg Dantlgraber, Lohr (DE); David Breuer, Tuebingen (DE); Joerg Weingart, Guenzburg (DE); Michael Gaumnitz, Horb (DE); Marcus Simon, Bretten (DE); Andreas Illmann, Weil der Stadt (DE); Christoph Gesterkamp, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 293 days.

(21) Appl. No.: 14/387,955

(22) PCT Filed: Mar. 21, 2013

(86) PCT No.: PCT/EP2013/055868
§ 371 (c)(1),
(2) Date: Sep. 25, 2014

(87) PCT Pub. No.: WO2013/143952
PCT Pub. Date: Oct. 3, 2013

(65) Prior Publication Data

US 2015/0078923 A1 Mar. 19, 2015

(30) Foreign Application Priority Data

Mar. 29, 2012 (DE) ..... 10 2012 006 289

(51) Int. Cl.
*F04B 1/10* (2006.01)
*F04B 1/12* (2006.01)
(Continued)

(52) U.S. Cl.
CPC ..... *F04B 1/24* (2013.01); *F01B 3/0085* (2013.01); *F03C 1/0652* (2013.01);
(Continued)

(58) Field of Classification Search
CPC ..... F04B 1/20; F04B 1/124; F04B 1/2035; F01B 3/0032; F01B 3/0052; F01B 3/0085
(Continued)

(56) References Cited

U.S. PATENT DOCUMENTS 2,146,133 A 2/1939 Tweedale
3,722,372 A * 3/1973 Freese ..... F01B 3/0032 91/504
(Continued)

FOREIGN PATENT DOCUMENTS

DE 40 24 319 A1 2/1991
DE 10 2007 011 411 A1 9/2008
(Continued)

OTHER PUBLICATIONS

International Search Report corresponding to PCT Application No. PCT/EP2013/055868, mailed Jun. 10, 2013 (German and English language document) (5 pages).

*Primary Examiner* — Peter J Bertheaud
(74) *Attorney, Agent, or Firm* — Maginot, Moore & Beck LLP

(57) ABSTRACT

The disclosure relates to a hydrostatic axial piston machine having a housing, having a drive shaft, to which a flange disc is fastened in a rotationally fixed manner, and having a swash plate, to which a rotor disc, driven by the drive shaft or the flange disc, is rotatably mounted, and having a plurality of displacement units arranged distributed between the flange disc and the rotor disc and around the axis of the drive shaft, each displacement unit comprising a cylinder sleeve and a piston which extends into the cylinder sleeve and has a ball head and a spherical joint head which extends into the cylinder sleeve, wherein during operation, the piston plunges more or less far into the cylinder sleeve.

11 Claims, 1 Drawing Sheet

(51) Int. Cl.

| | |
|---|---|
| ***F04B 1/24*** | (2006.01) |
| ***F01B 3/02*** | (2006.01) |
| ***F04B 1/20*** | (2006.01) |
| ***F03C 1/32*** | (2006.01) |
| *F01B 3/00* | (2006.01) |

(52) U.S. Cl.
CPC ..... *F04B 1/2035* (2013.01); *F01B 3/0052* (2013.01); *F04B 1/124* (2013.01)

(58) Field of Classification Search
USPC ..... 417/269–272; 91/490, 499
See application file for complete search history.

(56) References Cited

U.S. PATENT DOCUMENTS 3,866,519 A * 2/1975 Miyao ..... F01B 3/0085 91/488
4,075,933 A * 2/1978 Stephens ..... F04B 1/20 91/506
4,253,381 A * 3/1981 Wartelle ..... F04B 1/124 91/506
4,872,394 A * 10/1989 Nakagawa ..... F04B 1/2035 91/506
5,094,147 A * 3/1992 Shaw ..... F01B 1/12 417/269
5,636,561 A * 6/1997 Pecorari ..... F04B 1/2035 123/43 A
5,971,717 A * 10/1999 Berthold ..... F01B 3/0052 417/269
6,874,994 B2 * 4/2005 Folsom ..... F04B 1/124 417/209
7,328,647 B2 * 2/2008 Achten ..... F01B 3/0067 417/269
7,470,116 B2 * 12/2008 Dantlgraber ..... F01B 3/0035 417/269
9,273,780 B2 * 3/2016 Schnell ..... F04B 1/124

FOREIGN PATENT DOCUMENTS

| | | | |
|---|---|---|---|
| DE | 10 2009 006 909 | A1 | 8/2010 |
| GB | 2 022 189 | A | 12/1979 |
| WO | 03/058035 | A1 | 7/2003 |
| WO | 2004/055369 | A1 | 7/2004 |

* cited by examiner

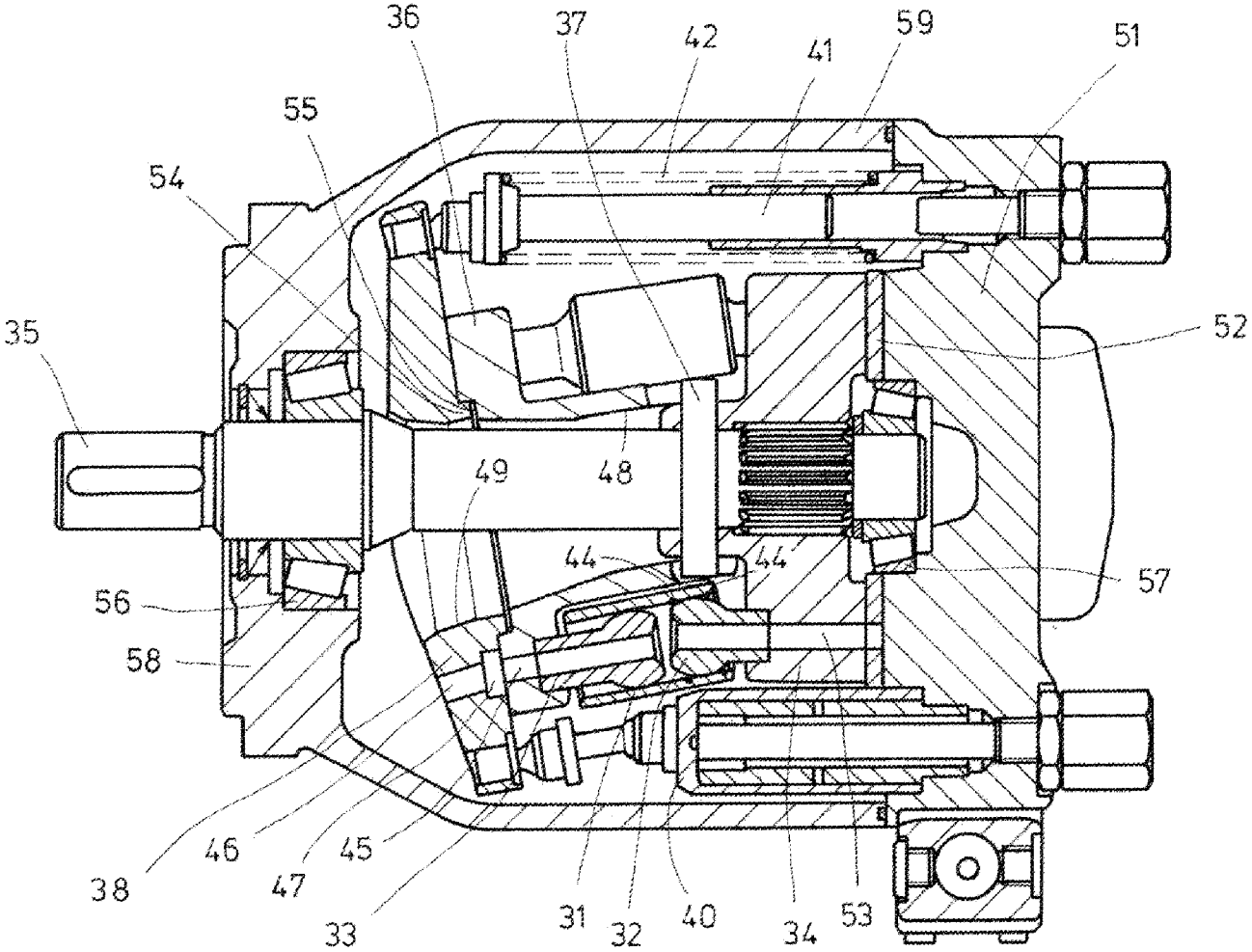
51
52
57
59
41
42
37
36
55
54
35
56
58
38
46
47
45
33
31
32
40
34
53
44
44
48
49

HYDROSTATIC AXIAL PISTON MACHINE

This application is a 35 U.S.C. §371 National Stage Application of PCT/EP2013/055868, filed on Mar. 21, 2013, which claims the benefit of priority to Serial No. DE 10 2012 006 289.3, filed on Mar. 29, 2012 in Germany, the disclosures of which are incorporated herein by reference in their entirety.

BACKGROUND

In the "swashplate" design principle for a hydrostatic axial piston machine of the conventional type, large transverse forces occur at the working piston owing to the principle involved, and these lead to jamming or high friction of the pistons in the piston bores. This has a negative effect in application as a hydraulic motor, especially when starting up from stationary, because the internal breakaway forces first of all have to be overcome. If a swashplate machine is used as a hydraulic motor in a vehicle, for example, the torque required for starting has to be produced by the hydraulic motor. In addition, the internal friction (breakaway torque) has to be overcome at the moment of starting. The displacement volume of the motor required for starting is thus increased by the displacement volume required to break away from the internal friction. As a result, a motor of this kind is increased in size by the proportion of the displacement volume which is required simply to break away. In the case of swashplate machines, this proportion for breaking away is about 30-40% of the displacement volume. By this proportion, a swashplate motor must be larger in size than would be necessary for actually breaking away.

Owing to the principle involved, the "oblique axis" design principle for an axial piston machine of a conventional kind has good starting behavior because only low transverse forces occur between the working piston and the piston bore. For this reason, this principle is generally applied as a hydraulic motor. In the known designs, the piston chamber is sealed against leakage by means of piston rings. During operation, this leads to relatively high frictional forces between the piston/piston ring and the piston bore. The result is that the range of small pivoting angles of the hydraulic motor is not usable because these frictional forces lead to a reduction in the useful torque. The result is a restricted conversion range of the hydraulic motor. (The range of small pivoting angles is not usable: approximately less than 5°).

Another disadvantage of the known oblique axis designs with a pivoting slide is that the maximum pivoting angle thereof is limited to about 30°. The reason for this are the force ratios at the pivoting slide. In the case of pivoting angles greater than 30°, the lifting force of the hydrostatic relief between the pivoting slide and the cylinder drum is greater than the contact force of the cylinder drum, and the drive mechanism would lift off. If greater swiveling angles than 30° are to be implemented, the known pivoting yoke design must therefore be used. However, this design is very large/heavy and is therefore unusable for many driving tasks (especially in the mobile sector). These two abovementioned disadvantages mean that the oblique axis design with a pivoting slide is now used exclusively as a variable displacement hydraulic motor in single-quadrant operation. This means that the motor can only be set to a "maximum pivoting angle" in one direction from the "zero pivoting angle" position. Theoretically, it would also be possible to make a two-quadrant machine with a pivoting slide. However, the conversion range would then be reduced to 15° per quadrant, minus the unusable pivoting angle of about 5° (because of the abovementioned friction), i.e. to about 10°. Owing to this small usable pivoting angle, the hydraulic motor would be very large and it would not be possible to use it in many applications, particularly in the mobile sector (excavators, wheeled loaders etc.) as a result. For hydrostatic travel drives, this currently means that the available hydraulic motors are operated with a closed circuit. Reversal of the direction of travel is accomplished by pivoting the pump through.

Another disadvantage of oblique axis design is that, for the reasons mentioned, the drive shaft can only be passed through the drive mechanism if the pivoting angle is restricted to a maximum of 15°. As a result, this machine is not capable of through drive. Multiple arrangement is not possible. If the design principle of the oblique axis is used as a pump, multiple arrangement or the installation of an additional feed pump or other auxiliary pump is not possible. An additional output is always required for another pump.

The significant disadvantage of the floating-cup design known from WO 2003/058035 A1 or of the tilting-cup design known from DE 10 2007 011 441 A1 consists in the restriction of the maximum pivoting angle to a maximum of about 10° owing to the principle involved. As a result, the machine is relatively large as compared with machines which allow a larger pivoting angle. Another disadvantage is that commutation of the displacers must be accomplished by means of the pivoting cradle since the piston neck does not allow commutation for space reasons. Moreover, the fixing of the cups presents difficulties at higher speeds of rotation. The cups tend to lift off. In addition, the cups cannot be 100% hydrostatically relieved since there is otherwise a risk of liftoff. This means that the prevailing friction at this point is higher than with 100% relief, owing to the principle involved.

SUMMARY

The underlying object of the disclosure is to improve a hydrostatic axial piston machine having the features from the preamble the efficiency over the entire operating range and thereby to increase the previous conversion range and to improve it in respect of starting behavior, particularly in operation or in use as a hydraulic motor. The principle on which it is based should make the design suitable for operating the machine in two-quadrant mode (driving a vehicle forward and in reverse by pivoting a hydraulic motor through), for operating the machine in an open circuit and for offering the possibility of through-drive.

The desired object is achieved with a hydrostatic axial piston machine which has a drive shaft, on which a flange disk is secured for conjoint rotation, a rotatable rotor disk, which is arranged or is adjustable in such a way that the axis of rotation thereof is oblique with respect to the axis of the drive shaft and which can be taken along by the drive shaft or the flange disk, and has a plurality of displacer units arranged in a manner distributed between the flange disk and the rotor disk and around the axis of the drive shaft, each displacer unit comprising a cylinder sleeve and a piston, which projects into the cylinder sleeve and has a ball head and a spherical joint head, which projects into the cylinder sleeve, and in which the joint heads are situated on the flange disk and the pistons are situated on the rotor disk. During operation, the pistons plunge to a greater or lesser extent into the cylinder sleeves, while the joint heads and the cylinder sleeves can only be pivoted relative to one another. The axis of a piston and the axis of the associated cylinder sleeve, which passes through the centers of the ball heads of the pistons and of the joint heads, intersect only at small angles, and therefore the piston and the cylinder sleeve are virtually aligned relative to one another in respect of the axes thereof, thus allowing the pistons to be designed with a large diameter.

In the case of the hydrostatic axial piston machines known from WO 2004/055369 A1 or DE 10 2007 011 441 A1, in which the displacer units also already have cylinder sleeves into each of which a joint head and a piston that moves along a cylinder sleeve during operation plunge, the torque is produced at the pistons (motor operation being under consideration), which are also performing the stroke in the cylinder sleeves. This has the particular disadvantage, among others, that the pistons have only a small diameter at the foot thereof, in comparison with the diameter at the head thereof, since there must be free space at the foot for the cylinder sleeves, which are more or less oblique relative to the pistons. As a result, the pistons are weakened. In contrast, the torque is produced at the joint head while the piston performs the stroke in a hydrostatic axial piston machine according to the disclosure.

Because of the spherical ends of the pistons and of the joint heads, it is also possible to refer to a hydrostatic axial piston machine with a double-ball drive mechanism.

Thus, a preferred embodiment consists in that the drive shaft is mounted in rotary bearings on both sides of the flange disk, and in that the rotor disk is arranged between the flange disk and one rotary bearing and has a central passage for the drive shaft.

The rotor disk preferably has a flat sliding surface opposite a sliding partner fixed in the direction of rotation of the drive shaft, and is centered relative to the sliding partner, wherein this centering of the rotor disk and of the sliding partner on one another is advantageously accomplished by a centering collar on one part and a turned centering recess on the other part.

The obliquity of the sliding partner relative to the axis of the drive shaft can preferably be varied, and therefore the stroke travels of the pistons and hence the displacement volume of the axial piston machine can also be varied. In particular, the sliding partner with respect to which the rotor disk rotates is a swashplate which is fixed in the direction of rotation of the drive shaft, which then, like the rotor disk, has a central passage for the drive shaft and the obliquity of which relative to the axis of the drive shaft can be varied.

In a particularly advantageous manner, the displacer spaces can be connected fluidically to two working ports in alternation during operation by means of the flange disk and a distributor plate, on which the flange disk rests. Thus the commutation of the displacer spaces between high pressure and low pressure then takes place via the joint heads, the flange disk and a distributor plate, which can also be a housing part. The joint heads thus have a central bore for commutation. This central bore can be of larger diameter than in the pistons since the joint heads do not have to be so constricted at the foot thereof as the pistons. Thus, large flow cross sections with only small line losses are possible, even if these volume flows are not passed via a rotor disk. The fact that the volume flows do not pass via the rotor disk makes the design simpler, especially if the rotor disk is adjustable in the obliquity thereof.

It is expedient if the pistons or the joint heads have recesses open toward the displacer spaces for gap compensation. Thus, of the two components, it is not only the one through which commutation takes place which is hollow but also the other.

The obliquity of the rotor disk relative to the axis of the drive shaft can preferably be varied. The hydrostatic axial piston machine according to the disclosure is therefore preferably a machine of adjustable displacement volume (swept volume or volume consumed per revolution). In particular, the obliquity of the rotor disk can be pivoted in opposite directions from a position in which the stroke of the pistons in the cylinder sleeves is zero. The term "hydraulic machine that can be pivoted via zero or via a zero position" is also used. As a motor, a machine of this kind makes it possible to reverse the direction of rotation of the output shaft simply by the adjustment via zero and hence to implement two-quadrant operation and, for example, driving forwards and driving in reverse of a vehicle. If the hydraulic machine can then also be operated as a pump, four-quadrant operation is obtained with the possibility of positive and negative torques and rotation in opposite directions.

It is particularly advantageous if, in addition to the filling of the displacer spaces by the low-pressure port and the kidney-shaped low-pressure aperture in the distributor plate, filling is also possible from the housing of the hydraulic machine, which is operated primarily as a hydraulic motor but is also capable of operation as a hydraulic pump. For this purpose, the interior of the housing is additionally connected to the low-pressure port. The additional filling of the displacer spaces from the housing is accomplished via openings on the opposite side of the displacer from the low-pressure kidney-shaped aperture in the distributor plate.

BRIEF DESCRIPTION OF THE DRAWING

FIG. 1 shows an illustrative embodiment of a hydrostatic axial piston machine according to the disclosure.

DETAILED DESCRIPTION

The axial piston machine shown in FIG. 1 is one based on the structure of axial piston machines of swashplate construction and is provided for use as a hydraulic motor. The disclosure is now explained in greater detail by means of the hydrostatic axial piston machine shown.

The displacer spaces of the axial piston machine shown are each formed by a cylinder sleeve 31, a joint head 32 and a piston 33. The joint head and the piston are each of spherical design at the ends which form the boundary of the displacer space. In addition to the sealing function, the kinematically necessary joint function is thereby simultaneously formed. In addition, this arrangement has the advantage that the joint function is performed with a hydrostatic relief of 100 percent both on the part of the joint head and on the part of the piston owing to the principle involved (ball in tube). Owing to the principle involved, the highly stressed joints of the hydraulic machine are therefore of low-friction design.

Moreover, this arrangement has the advantage that all the elements are connected positively to one another owing to the principle involved. As a result, it is possible to dispense completely with a nonpositive connection between the joint head and the cylinder sleeve or between the cylinder sleeve and the piston (e.g. by means of springs). As a result, the displacer principle involves little friction owing to the principle involved. By virtue of the positive connection of the displacer, there is a suitability for high speeds of rotation owing to the principle involved.

The joint head and the piston have recesses, which allow gap compensation between the balls and the cylinder sleeve, which expands under pressure. The recess is designed in such a way that the remaining gap between the cylinder sleeve and the joint head or between the cylinder sleeve and the piston remains constant in a controlled manner under pressure or becomes smaller or becomes larger under pressure because the ball expands in a pressure-dependent manner. It is thereby possible to selectively influence the leakage losses via these gaps.

The joint heads 32 are secured on the flange disk 34 and convert the hydraulic forces from the displacer spaces into a torque at the drive shaft 35. The axes of the joint heads are oriented parallel to the axis of the drive shaft. The centers of the ball heads of the joint heads 32 are thus all situated in the same plane perpendicular to the axis of the drive shaft. With the aid of two retaining rings 44, the joint heads 32 and the cylinder sleeves are held relative to one another in such a way that only a pivoting movement takes place between them. The pistons 33 are secured on the rotor disk 36 and perform a stroke motion relative to the cylinder sleeves 31. The axes of the pistons 33 extend obliquely to the axis of the drive shaft in accordance with the variable obliquity of the rotor disk.

The rotor disk is taken along synchronously with the speed of rotation of the flange disk 34 by a driver pin 37, which is mounted in a hole in the drive shaft and engages in slots in a collar of the rotor disk, wherein a pivoting movement between the drive shaft and the rotor disk takes place upon rotation. Driving can also be accomplished by means of a Cardan joint, a constant-velocity joint or similar, for example. The rotor disk is rotatably mounted on the pivoting cradle (swashplate) 38, e.g. by means of a hydrostatic bearing or by means of a rolling bearing. The rotor disk is centered on the swashplate by means of a centering collar 54 on the swashplate and a turned centering recess 55 on the rotor disk.

The drive shaft 35 is rotatably mounted on both sides of the flange disk 34 with the aid of taper roller bearings 56 and 57 in the bottom 58 of a housing cup 59 and in a housing cover 51. The rotor disk 36 and the swashplate 38 are arranged between the flange disk 34 and the taper roller bearing 56, i.e. between the flange disk 34 and the bottom 58 of the housing cup 59, and each have a central passage 48, 49 for the passage of the drive shaft 35. The drive shaft passes through the bottom 58 to the outside and, on the outside, has a shaft stub so that it can be connected thereby to a driving machine part or a machine part to be driven.

The stroke adjustment of the pistons is accomplished, as in a conventional swashplate design, by means of an adjusting system which a first adjusting piston 40 with a large effective area designed as a sleeve, which is controlled by a valve (not shown specifically), and an adjusting piston 41 of small effective area, which is subjected continuously to the high pressure at a working port. The adjusting pistons are single acting pistons and operate in opposition to one another in relation to the pivoting axis of the swashplate. Acting in the same direction as adjusting piston 41 is a return spring 42, which defines a rest position of the swashplate.

The swashplate can be pivoted in opposite directions from a zero position, in which it occupies a position in which the pistons 33 do not perform a stroke. The terms "pivoting via zero" or "pivoting through" are also used. Thus, the hydrostatic machine is suitable for use as a variable displacement motor in an open circuit and for secondary control, i.e. for control of the speed or torque of the machine independently of the instantaneously applied high pressure, where it is possible not only to change the direction of rotation but also to make a transition from motor operation to pump operation. Here, secondary control contrasts with primary control, in which the delivery rate of the pump, i.e. of the primary unit, is specified. In a secondary control system, the pump is generally pressure-regulated but the pressure specified can be variable.

Commutation is accomplished by means of a high-pressure passage and a low-pressure passage, which lead from connection points (not shown specifically) situated on the housing cover 51 to a distributor plate 52, which is arranged non-rotatably relative to the housing cover, between the flange disk 34 and the housing cover 51. The flange disk 34 and the distributor plate 52 form a sliding pair. Formed in the distributor plate are two arc-shaped apertures (not shown), each of which is open toward one of the passages in the housing cover 51 and with which individual passages 53 in the flange disk, which each lead through a joint head 32 to a displacer space, come into overlap during rotation of the flange disk 34.

The arrangement according to the illustrative embodiment allows a continuous drive shaft 35 and hence through-drive and the arrangement of a plurality of machines in series. Through-drive of this kind is also possible if, in a variant of the axial piston machine shown, the flange disk 34 is situated close to the bottom and the rotor disk and the swashplate are situated close to the cover or if the shaft stub is situated at the cover end.

As in conventional hydrostatic axial piston machines of swashplate construction, commutation of the displacers is accomplished by a distributor plate 52 and the flange disk 34. As a result, adjustment is possible irrespective of the requirements for commutation and of the hydrostatic mounting of the flange disk. Large pivoting angles and pivoting through can be achieved.

In addition or as an alternative to the illustrated commutation of the displacers by the flange disk, the displacers can also be commutated by the pivoting cradle 38, rotor disk 36 and pistons 33. By means of the additional commutation, the flow losses during commutation can be reduced. The maximum speed of the machine can be raised. In particular, it appears advantageous if, in the case of a hydraulic machine which, by virtue of adjustment via zero, can be operated both as a hydraulic motor and also as a hydraulic pump, for example when used in a travel drive and then when braking, additional filling of the displacer spaces by means of the pivoting cradle 38, rotor disk 36 and pistons 33 is possible as well as filling via the distributor disk. This is because, without an additional pressure medium path for filling, the displacer spaces must be filled exclusively via the kidney-shaped low-pressure aperture in the distributor plate 52 in the case of a low pressure gradient in pump mode in an open hydraulic circuit. The axial piston machine shown therefore has hollow pistons 33 and holes 45 in the rotor disk 36 which are associated with the pistons. In the angular range in which the holes 53 in the flange disk 34 cross the kidney-shaped low-pressure aperture in the distributor plate 52, these holes cross a groove 47 in the swashplate 38, said grooves being connected by one or more openings 46 to the interior of the housing. For the sake of clarity, the opening 46 and the groove 47 are depicted in the FIGURE even though, in reality, they are turned relative to the position shown and are actually not visible in the section according to the FIGURE.

Filling of the displacer spaces of a hydraulic machine used in an open hydraulic circuit from the low pressure via at least two pressure medium paths is used not only in the hydraulic machine shown with a double-ball drive mechanism but also in hydraulic machines of conventional swashplate construction, in hydraulic machines with a floating-cup drive mechanism or in any other adjustable displacer drive mechanism (particularly one on a piston/bore basis).

The principal advantages of a hydrostatic axial piston machine according to the disclosure, particularly the hydrostatic axial piston machine described as an illustrative embodiment, may be regarded as the following:

direct conversion of the hydraulic power of the displacer into torque in a manner free from transverse forces;

significantly better starting behavior as a hydraulic motor in comparison with swashplate designs, better starting behavior than oblique-axis designs;

significantly extended conversion range (useful pivoting range in practice) as compared with oblique-axis designs;

a reduction in consumption by the hydraulic machines;

machine can pivot through (in addition to the abovementioned characteristics) and is therefore suitable as an open-circuit hydraulic motor (secondary control);

a reduction in costs since an open circuit requires fewer components than a closed circuit;

in principle, the machine is capable of through drive (multiple arrangement possible as in swashplate designs).

direct conversion of the hydraulic power of the displacer into torque in a manner free from transverse forces;

significantly better starting behavior as a hydraulic motor in comparison with swashplate designs, better starting behavior than oblique-axis designs;

significantly extended conversion range (useful pivoting range in practice) as compared with oblique-axis designs;

a reduction in consumption by the hydraulic machines;

machine can pivot through (in addition to the abovementioned characteristics) and is therefore suitable as an open-circuit hydraulic motor (secondary control);

a reduction in costs since an open circuit requires fewer components than a closed circuit;

in principle, the machine is capable of through drive (multiple arrangement possible as in swashplate designs).

The invention claimed is:

1. A hydrostatic axial piston machine comprising:

a housing;

a drive shaft;

a flange disk arranged on the drive shaft and configured for conjoint rotation with the drive shaft;

a rotatable rotor disk arranged so that an axis of rotation of the rotatable rotor disk is at an oblique angle with respect to an axis of the drive shaft and so that the rotatable rotor disk is configured to be taken along by one of the drive shaft and the flange disk; and a plurality of displacer units arranged in a manner distributed between the flange disk and the rotor disk and around the axis of the drive shaft, each displacer unit comprising:

a cylinder sleeve, and a piston, having a ball head, and a spherical joint head projecting into the cylinder sleeve, wherein the piston of each displacer unit performs a stroke relative to a respective cylinder sleeve during operation, and wherein the joint head of each displacer unit is situated on the flange disk and the piston of each displacer unit is situated on the rotor disk.

2. The hydrostatic axial piston machine according to claim 1, wherein:

the drive shaft is mounted in a first rotary bearing on a first side of the flange disk and a second rotary bearing on a second side of the flange disk, and the rotor disk is arranged between the flange disk and one of the first and second rotary bearings and has a central passage for the drive shaft.

3. The hydrostatic axial piston machine according to claim 1, wherein the rotor disk has a flat sliding surface opposite a sliding partner fixed in a direction of rotation of the drive shaft, and the rotor disk is centered relative to the sliding partner by a centering structure.

4. The hydrostatic axial piston machine according to claim 3, wherein the centering structure comprises:

a centering collar on one of the sliding partner and the rotor disk; and a turned centering recess on the other of the sliding partner and the rotor disk.

5. The hydrostatic axial piston machine according to claim 1, wherein displacer spaces of the displacer units are configured to be connected fluidically to two working ports in alternation during operation by the joint heads, the flange disk and a distributor plate, on which the flange disk rests.

6. The hydrostatic axial piston machine according to claim 1, wherein the pistons and the joint heads define recesses open toward displacer spaces of the displacer units, the recesses being configured to compensate for a gap between the pistons and joint heads, and the cylinder sleeves.

7. The hydrostatic axial piston machine according to claim 1, wherein the oblique angle of axis of rotation of the rotor disk relative to the axis of the drive shaft is configured to be variable.

8. The hydrostatic axial piston machine according to claim 7, wherein the rotor disk rotates relative to a swashplate which is fixed in a direction of rotation of the drive shaft, has a central passage for the drive shaft, and the swashplate is at an oblique angle, relative to the axis of the drive shaft, that is configured to be variable.

9. The hydrostatic axial piston machine according to claim 7, wherein the oblique angle of the axis of rotation of the rotor disk is configured to be variable in opposite directions from a position in which the stroke of the pistons in the cylinder sleeves is zero.

10. The hydrostatic axial piston machine according to claim 1, further comprising:

a pressure medium path, via which displacer spaces of the displacer units are filled from an interior of the housing.

11. The hydrostatic axial piston machine according to claim 10, further comprising:

a low-pressure port connected to the interior of the housing.

* * * * *